US011788721B2

(12) United States Patent
Ibarra

(10) Patent No.: US 11,788,721 B2
(45) Date of Patent: Oct. 17, 2023

(54) CUBICAL WOOD SHARPENER AND MULTI-TOOL

(71) Applicant: Abraham Daniel Ibarra, San Antonio, TX (US)

(72) Inventor: Abraham Daniel Ibarra, San Antonio, TX (US)

( * ) Notice: Subject to any disclaimer, the term of this patent is extended or adjusted under 35 U.S.C. 154(b) by 152 days.

(21) Appl. No.: 17/152,145

(22) Filed: Jan. 19, 2021

(65) Prior Publication Data

US 2022/0228738 A1 Jul. 21, 2022

(51) Int. Cl.

| | |
|---|---|
| ***F21V 33/00*** | (2006.01) |
| ***B26B 3/04*** | (2006.01) |
| ***B25F 1/00*** | (2006.01) |

(52) U.S. Cl.

CPC ..... *F21V 33/0084* (2013.01); *B25F 1/00* (2013.01); *B26B 3/04* (2013.01)

(58) Field of Classification Search

CPC ..... F21V 33/0084; B25F 1/00; B26B 3/04; B43L 23/004; B43L 23/06

See application file for complete search history.

(56) References Cited

U.S. PATENT DOCUMENTS

| | | | | |
|---|---|---|---|---|
| 290,564 A | | 12/1883 | Foster | |
| 292,162 A | | 1/1884 | Foster | |
| 1,905,608 A | | 8/1930 | Schoenfeldt | |
| 2,558,902 A | * | 7/1951 | Itano | B43L 23/08 30/454 |
| 2,857,884 A | * | 10/1958 | Itano | B43L 23/08 30/454 |
| 4,281,698 A | * | 8/1981 | Mobius | B43L 23/08 30/454 |
| 4,336,729 A | * | 6/1982 | Eppenbach | B25F 1/00 81/439 |
| 5,379,524 A | * | 1/1995 | Dawson | B25F 1/00 33/760 |
| 6,782,576 B1 | * | 8/2004 | Valencic | B24D 15/06 7/170 |

(Continued)

OTHER PUBLICATIONS

"Survival Pencil Sharpener" uploaded on Mar. 11, 2015 by user "gideonstactical". Retrieved from Internet: https://www.youtube.com/watch?v=AYJ54nka4Lo (Year: 2015).*

(Continued)

*Primary Examiner* — Anne M Kozak
*Assistant Examiner* — Christopher Soto
(74) *Attorney, Agent, or Firm* — BAKER BOTTS L.L.P.

(57) ABSTRACT

An apparatus is disclosed. The apparatus comprises a housing. The housing has a top portion with an opening. The housing has a bottom portion having a plurality of discharge openings arranged around a center piece of the bottom portion. A plurality of support members are disposed in an interior of the housing, each extending from an edge of the top portion proximate to the opening to the center piece of the bottom portion. The housing has a plurality of blade receptacles, each of which has a first section disposed in the top portion and a second section extending along an edge of one of the plurality of support members. The housing has first, second, third, and fourth side portions. The apparatus comprises a plurality of blades, each of the plurality of blades disposed in a respective one of the plurality of blade receptacles of the housing.

18 Claims, 6 Drawing Sheets

(56) References Cited

U.S. PATENT DOCUMENTS

| | | | | |
|---|---|---|---|---|
| 7,523,557 | B2 | 4/2009 | Smith et al. | |
| 10,328,561 | B1 * | 6/2019 | Weinberger | F23Q 1/06 |

OTHER PUBLICATIONS

Lumberjack Tools 1" & 2" Commercial Starter Kit (CSK2), Amazon, https://www.amazon.com/Lumberjack-Tools-Commercial-Starter-CSK2/, 11 pages, printed Jan. 12, 2021.

Lumberjack Tools 2" Industrial Log Tenon Cutter, Premium Tenon Cutter (Tta2000), Amazon, https://www.amazon.com/Lumberjack-Tools-Industrial-Cutter-TTA2000, 9 pages, printed Jan. 12, 2021.

Karoto Vegetable Peeler, Curler, Spiral Ribbon Cutter and Shaver for Carrot, Zucchini, Cucumber, Potatoes, By Monkey Business, Amazon, https://www.amazon.com/Monkey-Business-Vegetable-Zucchini-Cucumber/dp/B00A6YSHMS, printed Jan. 12, 2021, 8 pages.

* cited by examiner

CUBICAL WOOD SHARPENER AND MULTI-TOOL

TECHNICAL FIELD

The present disclosure relates, in general, to camping and survival gear and, more particularly, to a wood sharpener and multi-tool and method for making the same.

BACKGROUND

Spending time outdoors is a favorite pastime of many people. Hiking and camping, in particular, are very popular activities around the world. Even the most leisurely of hikes or camping trips, however, has the potential to become dangerous. A wrong turn on a trail, or a failure to heed warning signs, can result in a hiker or camper finding themselves off the beaten path and lost in the wilderness. Without the proper tools, campers and hikers may be unprepared to survive in such precarious circumstances. Thus, prudent hikers or campers often go to great lengths to ensure that they have the proper equipment with them before embarking on an outdoor adventure.

Different types of camping and survival gear have been created in an attempt to outfit outdoor enthusiasts with the equipment needed to be ready to handle any situation that may be encountered. While these products offer some utility, they suffer from certain disadvantages. For instance, a thin blade on a pocket knife or other multi-tool may be capable of shaving a small piece of bark from a branch, but is not well-suited for generating the large quantity of wood shavings needed to, for example, serve as tinder for emergency fire starting. The blade may also be prone to dulling quickly, which diminishes its utility (especially in prolonged survival situations). And, if the surface of the wood is wet, such a small, potentially dull knife may not be suitable for cutting away wet wood to expose dry wood that may be used as tinder. Moreover, these types of tools may pose a danger to the user, as inexperienced users may be more likely to cut themselves (especially under the stresses that accompany a survival situation). Beyond these concerns, even the most versatile tool cannot address all the needs that a person might have in the wilderness. For example, a blade may be suitable for cutting, but not for grinding.

Thus, there is a need for improved camping and survival gear that addresses these and other deficiencies.

SUMMARY

To address the foregoing problems, disclosed is an apparatus. The apparatus comprises an integrally formed housing, the housing having a substantially cubical shape. The housing comprises a top portion, the top portion comprising an opening for receiving an object to be sharpened or shredded. The housing comprises a bottom portion disposed opposite the top portion, the bottom portion comprising a plurality of discharge openings arranged around a center piece of the bottom portion and a central discharge opening in the center piece. The housing comprises a plurality of support members disposed in an interior of the housing, each of the plurality of support members extending from an edge of the top portion proximate to the opening to the center piece of the bottom portion. The housing comprises a plurality of blade receptacles, each of the plurality of blade receptacles having a first section disposed in the top portion and a second section extending along an edge of one of the plurality of support members. The housing comprises first, second, third, and fourth side portions. The first side portion comprises a first cavity. The second side portion comprises a second cavity. The third side portion comprises a third cavity and a fourth cavity. The fourth side portion comprises a fifth cavity. A sixth cavity is disposed at a juncture between the third side portion and the fourth side portion. The apparatus comprises a plurality of blades, each of the plurality of blades disposed in a respective one of the plurality of blade receptacles of the housing. The apparatus comprises a mirror removably coupled to the housing in the first cavity. The apparatus comprises a compass removably coupled to the housing in the third cavity. The apparatus comprises a blade sharpener removably coupled to the housing in the fourth cavity. The apparatus comprises a flint piece removably coupled to the housing in the sixth cavity.

In certain embodiments, the apparatus may further comprise a cap removably coupled to the housing. The cap may comprise a plurality of projections arranged around a cap opening. The cap opening may substantially correspond in shape and size to the opening of the top portion. Each of the plurality of projections may contact a respective one of the plurality of blades when the cap is coupled to the housing. In certain embodiments, the cap may cover an opening of the second cavity and an opening of the fifth cavity when the cap is coupled to the housing.

In certain embodiments, the housing may be formed of acrylonitrile butadiene styrene.

In certain embodiments, an exposed surface of each of the plurality of support members may be abrasive.

In certain embodiments, one or more of the plurality of blades may comprise a serrated edge.

Also disclosed is an apparatus. The apparatus comprises a housing. The housing comprises a top portion, the top portion comprising an opening for receiving an object. The housing comprises a bottom portion disposed opposite the top portion, the bottom portion comprising a plurality of discharge openings arranged around a center piece of the bottom portion. The housing comprises a plurality of support members disposed in an interior of the housing, each of the plurality of support members extending from an edge of the top portion proximate to the opening to the center piece of the bottom portion. The housing comprises a plurality of blade receptacles, each of the plurality of blade receptacles having a first section disposed in the top portion and a second section extending along an edge of one of the plurality of support members. The housing comprises first, second, third, and fourth side portions.

In certain embodiments, the apparatus may comprise a plurality of blades, each of the plurality of blades disposed in a respective one of the plurality of blade receptacles of the housing.

In certain embodiments, the apparatus may comprise a cap removably coupled to the housing. The cap may comprise a plurality of projections arranged around a cap opening. The cap opening may substantially correspond in shape and size to the opening of the top portion. Each of the plurality of projections may contact a respective one of the plurality of blades when the cap is coupled to the housing. In certain embodiments, the cap may cover one or more cavity openings when the cap is coupled to the housing.

In certain embodiments, the housing may be integrally formed. In certain embodiments, the housing may have a substantially cubical shape.

In certain embodiments, the apparatus may comprise a mirror removably coupled to the housing in a cavity formed in one of the first, second, third, and fourth side portions.

In certain embodiments, the apparatus may comprise a compass removably coupled to the housing in a cavity formed in one of the first, second, third, and fourth side portions.

In certain embodiments, the apparatus may comprise a blade sharpener removably coupled to the housing in a cavity formed in one of the first, second, third, and fourth side portions.

In certain embodiments, the apparatus may comprise a flint piece removably coupled to the housing in a cavity formed at a juncture between two of the first, second, third, and fourth side portions.

In certain embodiments, an exposed surface of each of the plurality of support members may be abrasive.

In certain embodiments, one or more of the plurality of blades may comprise a serrated edge.

Also disclosed is a method. The method comprises integrally forming a housing. The housing comprises a top portion, the top portion comprising an opening for receiving an object. The housing comprises a bottom portion disposed opposite the top portion, the bottom portion comprising a plurality of discharge openings arranged around a center piece of the bottom portion and a central discharge opening in the center piece. The housing comprises a plurality of support members disposed in an interior of the housing, each of the plurality of support members extending from an edge of the top portion proximate to the opening to the center piece of the bottom portion. The housing comprises a plurality of blade receptacles, each of the plurality of blade receptacles having a first section disposed in the top portion and a second section extending along an edge of one of the plurality of support members. The housing comprises first, second, third, and fourth side portions. The method comprises removably coupling a plurality of blades to the housing, each of the plurality of blades disposed in a respective one of the plurality of blade receptacles of the housing.

In certain embodiments, integrally forming the housing may comprise one of: 3-D printing the housing using one of acrylonitrile butadiene styrene and polylactic acid; filling a mold of the housing with acrylic; and integrally forming the housing using plastic injection molding.

Certain embodiments of the present disclosure may provide one or more technical advantages. As one example, the apparatus disclosed herein may advantageously be used for shredding sticks or branches to, for example, efficiently create wood shavings that can be used as tinder for emergency fire starting as well as a variety of other purposes. The plurality of blades and their arrangement within the housing may advantageously increase the quantity of wood shavings produced as well as decrease the amount of time required to generate a sufficient amount of wood shavings. As another example, the apparatus disclosed herein may advantageously be used to quickly and safely create a sharp-pointed spear for use in hunting and/or fishing in a survival situation. As still another example, the design of the housing may advantageously make the shaving and/or sharpening process more efficient and safer for the user. As yet another example, the shape of the housing may advantageously enable the apparatus to be used for grinding an assortment of materials. Exposed surfaces of the support members may be abrasive in order to provide more effective and efficient grinding of materials. As another example, the plurality of discharge openings in the bottom portion may facilitate easy access to and collection of shavings or grounds created using the apparatus. As still another example, the apparatus may provide a number of removably coupled tools to facilitate a user's survival in the outdoors. For instance, a removably coupled mirror may enable emergency signaling. A magnifying glass may facilitate fire starting (e.g., using wood shavings generated using the apparatus). A removably coupled compass may facilitate a user finding his or her way to safety or other points of interest. A removably coupled blade sharpener may advantageously allow a user to sharpen the plurality of blades as needed (e.g., in the event that one or more of the plurality of blades begins to dull). A removably coupled flint piece may facilitate fire starting (e.g., using wood shavings generated using the apparatus). Other advantages may be readily apparent to one having skill in the art. Certain embodiments may have none, some, or all of the recited advantages.

BRIEF DESCRIPTION OF THE DRAWINGS

For a more complete understanding of the disclosed embodiments and their features and advantages, reference is now made to the following description, taken in conjunction with the accompanying drawings, in which.

DETAILED DESCRIPTION

Figure 1:
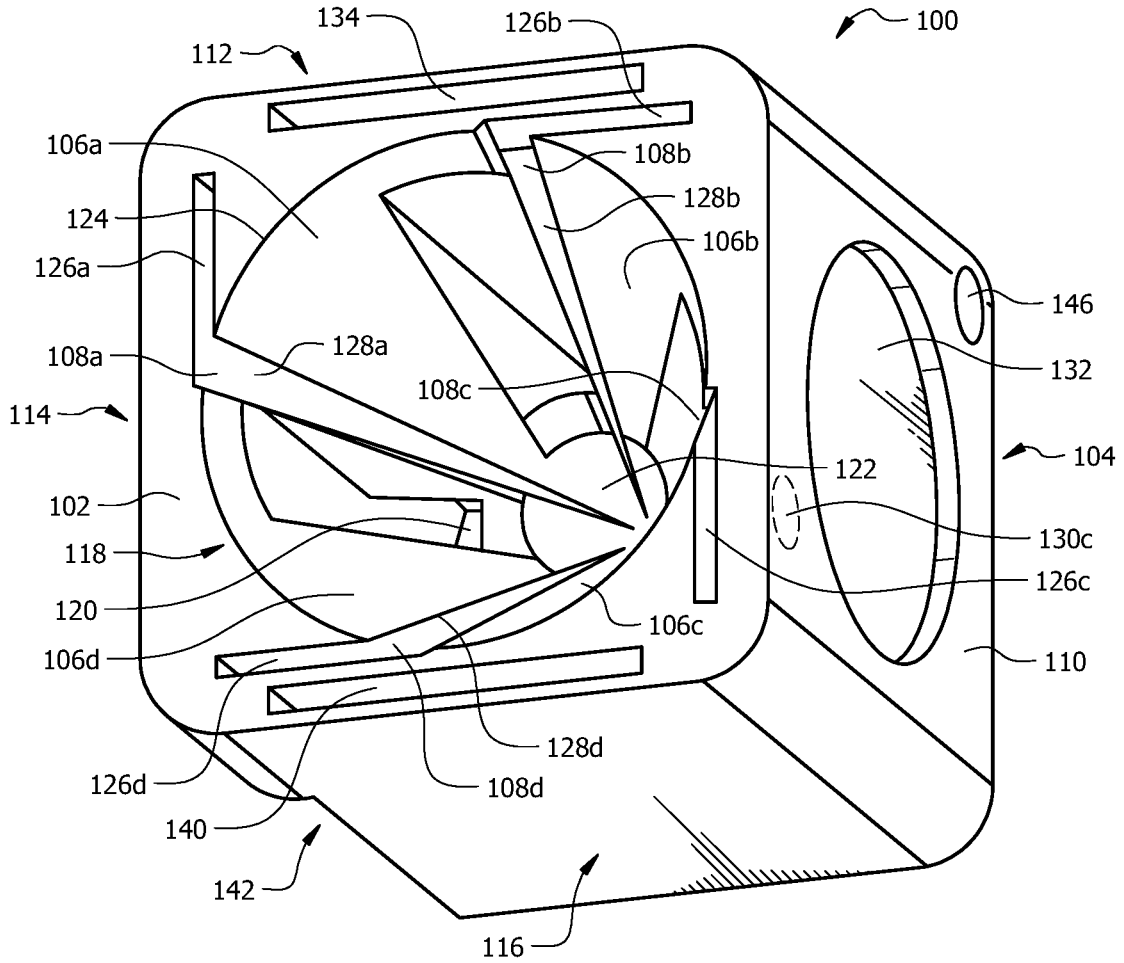
FIG. 1 illustrates an angled top-view of an exemplary housing of an apparatus, in accordance with certain embodiments.

Different types of camping and survival gear have been created in an attempt to outfit outdoor enthusiasts with the equipment needed to be ready to handle any situation that may arise. As described above, however, existing tools and equipment suffer from a variety of deficiencies. As a result of the above-described deficiencies, existing tools may have limited utility and even pose a danger to a user.

The present disclosure contemplates various embodiments that may address these and other deficiencies. In certain embodiments, this is achieved by a cubical wood sharpener housing a plurality of blades that are removably coupled to the housing. The cubical wood sharpener is engineered for outdoor wood sharpening (e.g., sharpening tree branches) and grinding (e.g., grinding bark, leaves, coffee, etc.) and a variety of other purposes. For example, the cubical wood sharpener can be used to make tinder for emergency fire starting (even when the environment is moist, as it allows for easy access to the dry wood at the interior of a dead tree branch) or to fabricate a spear for hunting wild game and spear fishing. The cubical shape of the wood sharpener may provide an ergonomic grip for the user to allow for more comfortable sharpening, sawing, and grinding. Use of the cubical wood sharpener may be enhanced using an ergonomically designed hand tool such as the one described herein.

Several embodiments are elaborated in this disclosure. According to one example embodiment, an apparatus is disclosed. The apparatus comprises an integrally formed housing having a substantially cubical shape. The housing comprises a top portion, a bottom portion, a plurality of support members, a plurality of blade receptacles, and first, second, third, and fourth side portions. The top portion comprises an opening for receiving an object (e.g., an object, such as a stick, to be sharpened or shredded). The bottom portion is disposed opposite the top portion and comprises a plurality of discharge openings arranged around a center piece of the bottom portion and a central discharge opening in the center piece. The support members are disposed in an interior of the housing. Each of the plurality of support members extends from an edge of the top portion proximate to the opening to the center piece of the bottom portion. Each of the plurality of blade receptacles has a first section disposed in the top portion of the housing and a second section extending along an edge of one of the plurality of support members. The first side portion comprises a first cavity. The second side portion comprises a second cavity. The third side portion comprises a third cavity and a fourth cavity. The fourth side portion comprises a fifth cavity. A sixth cavity is disposed at a juncture between the third side portion and the fourth side portion. The apparatus comprises a plurality of blades, each of the plurality of blades disposed in a respective one of the plurality of blade receptacles of the housing. The apparatus comprises a mirror removably coupled to the housing in the first cavity. The apparatus comprises a compass removably coupled to the housing in the third cavity. The apparatus comprises a blade sharpener removably coupled to the housing in the fourth cavity. The apparatus comprises a flint piece removably coupled to the housing in the sixth cavity.

Certain embodiments of the present disclosure may provide one or more technical advantages. As one example, the apparatus disclosed herein may advantageously be used for shredding sticks or branches to, for example, efficiently create wood shavings that can be used as tinder for emergency fire starting as well as a variety of other purposes. The plurality of blades and their arrangement within the housing may advantageously increase the quantity of wood shavings produced as well as decrease the amount of time required to generate a sufficient amount of wood shavings. As another example, the apparatus disclosed herein may advantageously be used to quickly and safely create a sharp-pointed spear for use in hunting and/or fishing in a survival situation. As still another example, the design of the housing may advantageously make the shaving and/or sharpening process more efficient and safer for the user. As yet another example, the shape of the housing may advantageously enable the apparatus to be used for grinding an assortment of materials. Exposed surfaces of the support members may be abrasive in order to provide more effective and efficient grinding of materials. As another example, the plurality of discharge openings in the bottom portion may facilitate easy access to and collection of shavings or grounds created using the apparatus. As still another example, the apparatus may provide a number of removably coupled accessory tools to facilitate a user's survival in the outdoors. For instance, a removably coupled mirror may enable emergency signaling. A magnifying glass may facilitate fire starting (e.g., using wood shavings generated using the apparatus). A removably coupled compass may facilitate a user finding his or her way to safety or other points of interest. A removably coupled blade sharpener may advantageously allow a user to sharpen the plurality of blades as needed (e.g., in the event that one or more of the plurality of blades begins to dull). A removably coupled flint piece may facilitate fire starting (e.g., using wood shavings generated using the apparatus). Other advantages may be readily apparent to one having skill in the art. Certain embodiments may have none, some, or all of the recited advantages.

Some of the embodiments contemplated by the present disclosure will now be described more fully with reference to the accompanying drawings. Other embodiments, however, are contained within the scope of the subject matter disclosed herein. The disclosed subject matter should not be construed as limited to only the example embodiments set forth herein; rather, these embodiments are provided by way of example to convey the scope of the subject matter to those skilled in the art.

FIG. 1 illustrates a first angled top-view of an exemplary housing of an apparatus, in accordance with certain embodiments. More particularly, FIG. 1 illustrates a housing 100. In the example embodiment of FIG. 1, housing 100 has a substantially cubical shape. In certain embodiments, housing 100 may be integrally formed. Housing 100 may be integrally formed in a variety of ways (e.g., using 3-D printing, plastic injection molding, etc.) and using a variety of materials. Exemplary materials include, but are not limited to, acrylonitrile butadiene styrene (ABS) (a type of plastic that may be used with 3-D printers), acrylic, and polylactic acid (an environmentally-friendly plastic made from cornstarch), or another suitable material. In an alternative embodiment, housing 100 may be formed by assembling one or more separate components to form housing 100.

In the example embodiment of FIG. 1, housing 100 comprises a top portion 102, a bottom portion 104, a plurality of support members 106, a plurality of blade receptables 108, a first side portion 110, a second side portion 112, a third side portion 114, and a fourth side portion 116. Top portion 102 of housing 100 comprises an opening 118 (e.g., a circular opening in the example embodiment of FIG. 1 or another suitable shape). Opening 118 may have a size and shape adapted to receive an object to be shaved or sharpened (e.g., a stick, branch, etc.) or ground (e.g., leaves, bark, coffee beans, etc.). The dimensions of opening 118 may vary in different implementations. In one example embodiment, however, opening 118 may be circular and have a diameter of approximately 1 inch.

Bottom portion 104 of housing 100 (only partially visible in FIG. 1) is disposed opposite top portion 102. As described in more detail below in relation to FIG. 2, bottom portion 104 comprises a plurality of discharge openings 120 (only one of which is visible in FIG. 1) arranged around a center piece 122 of bottom portion 104 and a central discharge opening 123 in center piece 122.

Housing 100 also includes a plurality of support members 106. More particularly, in the example embodiment of FIG. 1 housing 100 includes four support members 106*a*, 106*b*, 106*c*, and 106*d* disposed in the interior of housing 100. As can be seen from FIG. 1, each of support members 106*a*, 106*b*, 106*c*, and 106*d* extends from an edge 124 of top portion 102 (proximate to opening 118) to center piece 122 of bottom portion 104. Each support member 106 is spaced apart from other support members in order to allow shavings or grounds to pass through the interior of housing 100 towards bottom portion 104 and out of discharge openings 120, 123. In certain embodiments, an exposed surface of support members 106 may be abrasive, which may facilitate grinding. The abrasive surface may be attained as part of the integral forming process. Alternatively, in certain embodiments a metal plate having a grating surface may be affixed to exposed surfaces of support members 106.

Housing 100 also includes a plurality of blade receptacles 108. In the example embodiment of FIG. 1, housing 100 includes blade receptacles 108*a*, 108*b*, 108*c*, and 108*d*. Each of blade receptacles 108*a-d* has a size and shape adapted to fit a respective one of a plurality of blades. Each of blade receptacles 108*a*, 108*b*, 108*c*, and 108*d* has a first section 126 disposed in top portion 102 and a second section 128 extending along an edge of one of the plurality of support members 106 toward center piece 122 of bottom portion 104. More particularly, blade receptacle 108*a* comprises a first section 126*a* in top portion 102 and a second section 128*a* extending along an edge of support member 106*a*. Blade receptacle 108*b* comprises a first section 126*b* in top portion 102 and a second section 128*b* extending along an edge of support member 106*b*. Blade receptacle 108*c* comprises a first section 126*c* in top portion 102 and a second section 128*c* extending along an edge of support member 106*c*. Blade receptacle 108*d* comprises a first section 126*d* in top portion 102 and a second section 128*d* extending along an edge of support member 106*d*. A blade may be inserted in each of blade receptacles 108*a-d*. As described in more detail below in relation to FIG. 3, each of the blades has a shape designed to fit blade receptacles 108. The blades may be removably coupled to the housing (e.g., using a cap or a fastener) as described in more detail below.

Optionally, each of first side portion 110, second side portion 112, third side portion 114, and fourth side portion 116 may have a respective aperture 130*a*, 130*b*, 130*c*, and 130*d*. Only aperture 130*c* in first side portion 110 is shown in FIG. 1 for purposes of example. It should be understood, however, that in certain embodiments each of second side portion 112, third side portion 114, and fourth side portion 116 may comprise similar apertures, located in corresponding positions. When present, each of apertures 130*a-d* may be aligned with a respective one of first sections 126*a-d*. For example, in the example embodiment of FIG. 1 aperture 130*c* is aligned with first section 126*c* of blade receptacle 108*c*. This alignment allows a fastener to pass through an aperture 130 and into a first section 126 to secure a blade within a blade receptacle 108.

Alternatively, in certain embodiments the plurality of blades may be secured using a cap removably coupled to the housing. As described in more detail below in relation to FIG. 4, the cap may comprise a plurality of projections arranged around a cap opening. The cap opening may substantially correspond in shape and size to opening 118. Each of the plurality of projections may contact a respective one of the plurality of blades when the cap is coupled to the housing, securing the plurality of blades in blade receptacles 108.

In certain embodiments, first side portion 110, second side portion 112, third side portion 114, and fourth side portion 116 may have one or more cavities. The various cavities may be adapted to hold one or more accessory tools. In the example embodiment of housing 100 illustrated in FIG. 1, each of first side portion 110, second side portion 112, third side portion 114, and fourth side portion 116 has one or more cavities. More particularly, first side portion 110 has a first cavity 132, second side portion 112 has a second cavity 134, third side portion 114 has a third cavity 136 and a fourth cavity 138 (not explicitly shown in FIG. 1), and fourth side portion 116 has a fifth cavity 140. Housing 100 also has a sixth cavity 142 disposed at a juncture between third side portion 114 and fourth side portion 116. Those cavities expressly shown in FIG. 1 (including first cavity 132 in first side portion 110, second cavity 134 in second side portion 112, fifth cavity 140 in fourth side portion 116, and sixth cavity 142 disposed at a juncture between third side portion 114 and fourth side portion 116) are described in more detail below in relation to FIG. 1. Third cavity 136 and fourth cavity 138 in third side portion 114 will be described in more detail below in relation to FIG. 2. The various cavities and the associated accessory tools are also described in more detail below in relation to FIG. 6.

In certain embodiments, first cavity 132 may have a size and shape adapted to receive a mirror. The mirror may be removably coupled to housing 100. For example, the dimensions of first cavity 132 and the mirror may be complementary such that the mirror snaps into place, securing the mirror within first cavity 132 in first side portion 110 of housing 100. Alternatively, in certain embodiments housing 100 may include one or more apertures in first cavity 132 such that the mirror can be secured to housing 100 using one or more fasteners.

In certain embodiments, second cavity 134 may have a size and shape adapted to store one or more objects. For example, second cavity 134 may have a size and shape adapted to store a magnifying glass. Second cavity 134 in second side portion 112 may be accessible proximate top portion 102 of housing 100.

In certain embodiments, fifth cavity 140 may have a size and shape adapted for storing one or more objects. In certain embodiments, fifth cavity 140 may have dimensions large enough to store a plurality of blades. For example, fifth cavity 140 may store an extra set of blades for use in the event that the plurality of blades in blade receptacles 108 are damaged. Alternatively, fifth cavity 140 may store the blades upon removal from blade receptacles 108 when not in use. In certain embodiments, fifth cavity 140 may be used to store a survival guide (e.g., a small booklet with survival tips). Similar to second cavity 134, fifth cavity 140 in fourth side portion 116 may be accessible proximate top portion 102 of housing 100.

As described above and in more detail below in relation to FIG. 4, in certain embodiments a cap may be removably coupled to housing 100. When the cap is removably coupled to the housing, second cavity 134 and fifth cavity 140 may be covered, such that, for example, a magnifying glass stored in second cavity 134 and any items stored in fifth cavity 140 are prevented from falling out of housing 100.

In certain embodiments, sixth cavity 142 may have a size and shape adapted to receive a flint piece. The flint piece may be removably coupled to housing 100. For example, the dimensions of sixth cavity 142 and the flint piece may be complementary such that the flint piece snaps into place, securing the flint piece within sixth cavity 142 disposed between third side portion 114 and fourth side portion 116 of housing 100. Alternatively, in certain embodiments housing 100 may include one or more apertures in cavity 142 such that the flint piece may be secured to housing 100 using one or more fasteners.

Although housing 100 is shown as having a substantially cubical shape in the example embodiment of FIG. 1, it should be understood that the scope of the present disclosure is not limited to the substantially cubical shape and that other shapes for housing 100 are possible. For example, a substantially spherical shape could be used for housing 100, and the first, second, third, and fourth side portions of the housing could each take the form of a quadrant of the spherical housing.

Figure 2:
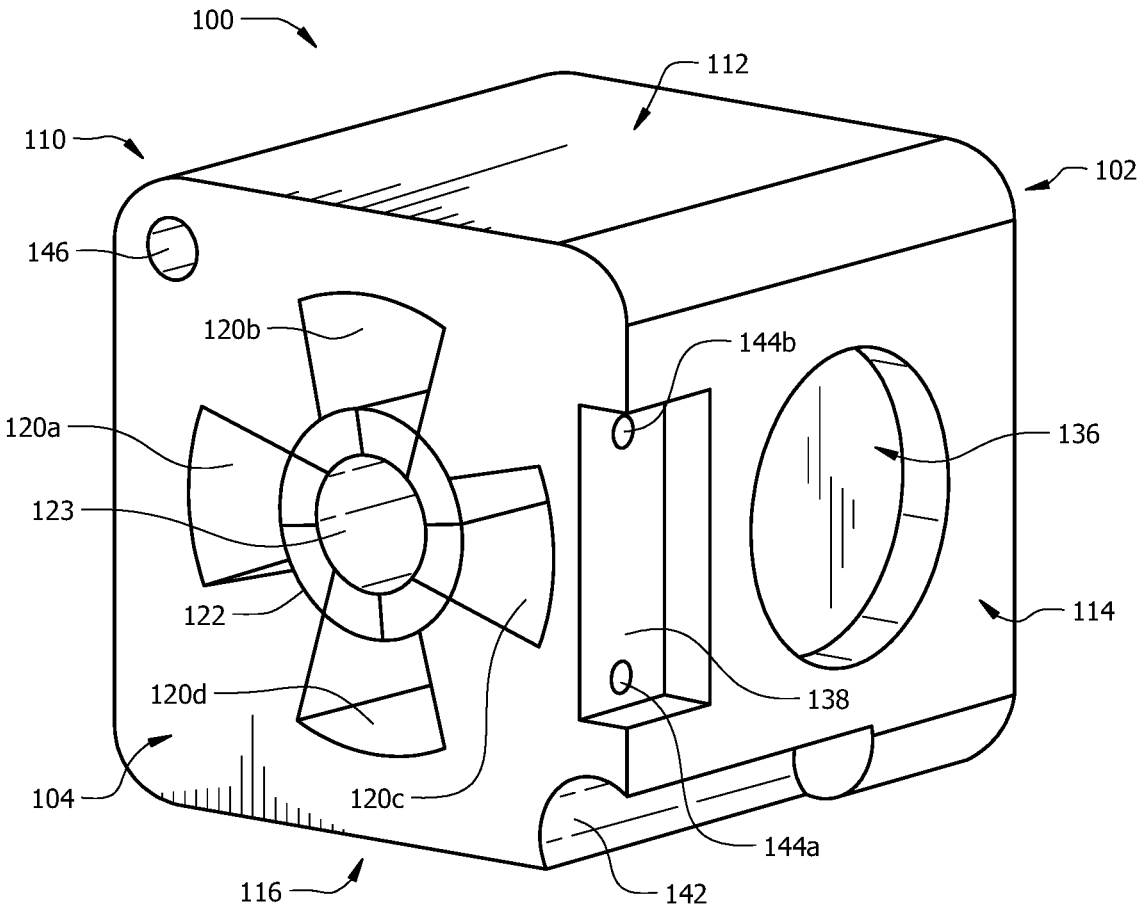
FIG. 2 illustrates an angled bottom-view of the exemplary housing of the apparatus, in accordance with certain embodiments.

FIG. 2 illustrates an angled bottom-view of the exemplary housing of the apparatus, in accordance with certain embodiments. More particularly, FIG. 2 is an angled bottom-view of housing 100 illustrated in FIG. 1, with like reference numerals used for like parts. Thus, only the additional portions of housing 100 illustrated in FIG. 2 will be described in detail.

FIG. 2 illustrates an aperture 146 located at a juncture between first side portion 110 and second side portion 112. Aperture 146 may be used to secure housing 100 to a backpack, beltloop, or other piece of equipment for ease of access and to prevent loss. For example, a lanyard or carabiner may be passed through aperture 146 and used to secure housing 100 to a backpack or beltloop.

As described above, bottom portion 104 of housing 100 comprises a plurality of discharge openings 120. In the example embodiment of housing 100 illustrated in FIG. 2, bottom portion 104 includes four discharge openings 120*a*, 120*b*, 120*c*, and 120*d*. Discharge openings 120*a*, 120*b*, 120*c*, and 120*d* are arranged around center piece 122 of bottom portion 104. In the example embodiment of housing 100 illustrated in FIG. 2, discharge openings 120 are spaced evenly around center piece 122. It should be understood, however, that the scope of the present disclosure is not limited to the precise number or arrangement of discharge openings illustrated in FIG. 2. Rather, any suitable number of discharge openings 120 in any suitable arrangement may be used, and the number and arrangement of discharge openings may vary according to different implementations. For example, in certain embodiments, one, two, three, or more than four discharge openings may be used. Additionally, in the example embodiment of housing 100 illustrated in FIG. 2, bottom portion 104 includes a central discharge opening 123 in center piece 122. Central discharge opening 123 in center piece 122 may advantageously allow fine dust to fall away and prevent dust from accumulating on the blades (when inserted in housing 100).

In the example embodiment of housing 100 illustrated in FIG. 2, third side portion 114 includes third cavity 136 and fourth cavity 138. In certain embodiments, third cavity 136 may have a size and shape adapted to receive a compass (e.g., a button compass). The compass may be removably coupled to housing 100. For example, the dimensions of cavity 136 and the compass may be complementary such that the compass snaps into place, securing the compass within cavity 136 in third side portion 114 of housing 100. Alternatively, in certain embodiments housing 100 may include one or more apertures in cavity 136 such that the compass may be secured to housing 100 using one or more fasteners.

In certain embodiments, fourth cavity 138 in third side portion 114 may have a size and shape adapted to receive a blade sharpener. The blade sharpener made be secured to housing 100 using one or more fasteners (e.g., one or more screws) such that the blade sharpener is securely held in place during use. Housing 100 may include a corresponding number of apertures (e.g., apertures 144*a*, 144*b*) in fourth cavity 138 for receiving the one or more fasteners. The blade sharpener may be removably coupled to housing 100 so that it can be replaced should it become worn down.

Figure 3:
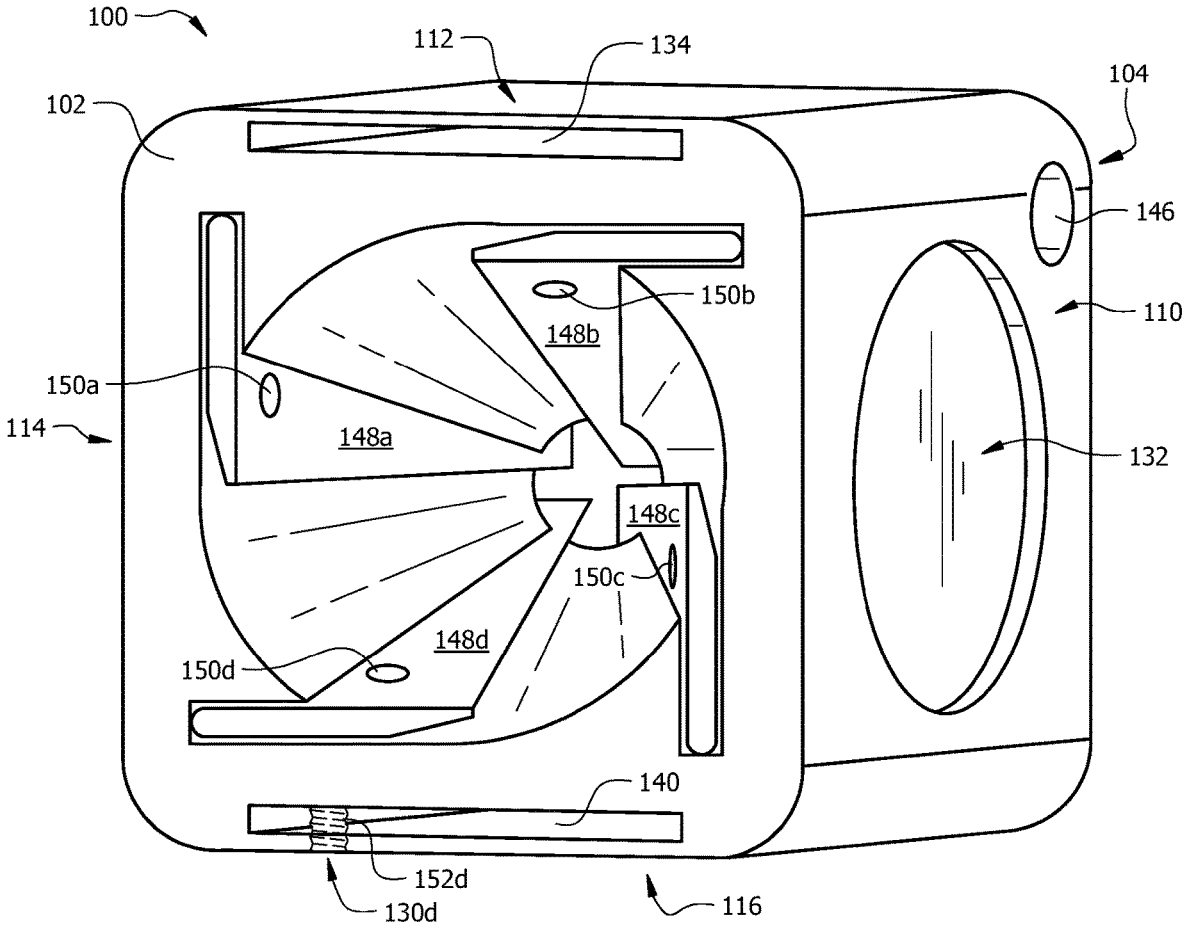
FIG. 3 illustrates a schematic drawing of the exemplary housing of the apparatus with a plurality of blades inserted, in accordance with certain embodiments.

FIG. 3 illustrates a schematic drawing of the exemplary housing with a plurality of blades inserted, in accordance with certain embodiments. More particularly, FIG. 3 is a schematic drawing of housing 100 described above in relation to FIGS. 1-2, except in FIG. 3 housing 100 is depicted with a plurality of blades 148*a-d* inserted. In the example embodiment of FIG. 3, blade 148*a* is inserted into blade receptacle 108*a*, blade 148*b* is inserted in blade receptacle 108*b*, blade 148*c* is inserted into blade receptacle 108*c*, and blade 148*d* is inserted into blade receptacle 108*d* (blade receptacles 108*a-d* are described above in relation to FIG. 1.

Blades 148*a-d* may be made of any suitable material. In certain embodiments, blades 148*a-d* may be formed from stainless steel. Other possible materials that may be used for blades 148 include iron, titanium, or other suitably strong metals. In certain embodiments, the use of stainless steel to form blades 148 may be preferable in order to prevent rust.

Each blade 148 may be removably coupled to housing 100. In certain embodiments, and as shown in the example embodiment of FIG. 3, each blade 148 may have an aperture 150. More particularly, blade 148*a* may have aperture 150*a*, blade 148*b* may have aperture 150*b*, blade 148*c* may have aperture 150*c*, and blade 148*d* may have aperture 150*d*. In such a scenario, when blades 148*a-d* are inserted in their respective blade receptacles 108*a-d*, apertures 150*a-d* are positioned in corresponding first sections 126*a-d* of blade receptacles 108*a-d*. In the inserted position, each of apertures 150*a-d* aligns with a corresponding one of apertures 130*a-d* (when present). This alignment allows respective fastener 152 (e.g., a screw) to be inserted into each of apertures 130, and through apertures 150 of blades 148, to secure blades 148 in position in housing 100. For example, blade 148*d* may be secured to housing 100 using a fastener 152*d* that passes through aperture 130*d* and aperture 150*d*. Removably coupling blades 148 to housing 100 advantageously allows the blades to be removed in order to replace or sharpen blades 148 when they become dull or, for example, to swap out a serrated blade for non-serrated blade.

Although FIG. 3 illustrates an example embodiment in which blades 148 are secured to housing 100 using fasteners 150, it should be understood that the present disclosure is not limited to the example embodiment of FIG. 3. Rather, the present disclosure contemplates that blades 148 may be secured to housing 100 by other suitable means. For example, in certain embodiments blades 148 may be secured to housing 100 using a cap that fits over top portion 102 of housing 100 (such as the cap described below in relation to FIG. 4) that secures blades 148 in place.

Additionally, although the example embodiments illustrated in FIGS. 1-3 are shown with four blade receptacles 108 and four blades 148, it should be understood that the present disclosure is not limited to this example embodiment. Rather, the present disclosure contemplates that any suitable number of blades could be used. For example, in certain embodiments, one, two, three, or more than four blades may be used. It should be apparent to one of ordinary skill in the art that decreasing or increasing the number of blades may require corresponding changes to the number of support members 106, blade receptacles 108, and blades 148.

In operation, the apparatus comprising housing 100 and blades 148 may be used for a variety of advantageous purposes. The apparatus may be used to create wood shavings. For instance, a user may insert an end of a stick or branch into circular opening 118 to the point that the stick or branch contacts support members 106 and blades 148. Depending on the orientation of blades 148, the user may rotate the stick or branch against the plurality of blades 148 in a clockwise or counterclockwise manner, causing each of the plurality of blades 148 to simultaneously shave thin slices of bark or wood from the stick or branch. Housing 100 is formed such that the generated shavings will fall between support members 106 towards bottom portion 104 and out through discharge openings 120, 123 where they can be collected and put to use. Advantageously, repeated turning of the stick or branch within the apparatus generates a sharp point on the stick or branch. The positioning of the blades within the interior of the housing provides an extra level of safety for the user, because it does not require the user to control any of the blades, thereby reducing the risk that a user might cut themselves. Additionally, the plurality of blades 148 and their arrangement in housing 100 may advantageously allow the apparatus to continue to function even if some of the blades 148 are damaged (e.g., cracked or dulled).

In addition to shaving and sharpening, the apparatus (with or without blades 148 inserted) may be used for grinding materials. For instance, bark, leaves, and other materials (e.g., coffee beans) may be inserted into the housing through circular opening 118 of top portion 102. Using a stick or other tool (e.g., in a circular motion), the inserted materials can be pressed against support members 106 and blades 148 in order to effectively grind them. As with the wood shavings discussed above, the design of the housing allows the ground material to fall between support members 106 towards bottom portion 104 and out through discharge openings 120, 123 where they can be collected and put to use. As described in more detail below in relation to FIG. 5, serrated blades may be used to increase the effectiveness and efficiency of the grinding process.

The wood shavings generated by the apparatus may be put to a wide variety of uses. As one example, the wood shavings may be used tinder for emergency fire starting. Even in wet climates, the apparatus facilitates obtaining sufficient wood shavings to use as tinder for fire starting by enabling a user to quickly and efficiently shave off wet wood from the exterior of a stick or branch to get to drier, more useful wood underneath. Additionally, the wood shavings or grounds can be used as an emergency source of food for survival purposes. It has been shown that branches/tree bark contain digestive starches, vitamins, minerals, and fiber. Using the apparatus described herein allows the wood shavings/grounds to be produced in quantities substantial enough to provide extra nutrition until a user is able to escape the situation. In a similar vein, the apparatus may be used for natural medicine zesting, to grind tea leaves for brewing, to create a natural water filter, create an incense as a natural pest repellant, and a wide array of other applications.

An additional advantage of the apparatus described herein is that, because the blades 148 are removable, they could be used for self-defense, for hunting and field dressing animals, making traps, and other survival tooling needs.

Although the uses for the apparatus described herein have been described primarily in the context of outdoor survival, it should be readily apparent that other uses are possible. As one example, scaling up the size of housing 100 and blades 148 could advantageously enable a variety of industrial applications (e.g., creating shredded wood pulp for paper products, plywood, etc.).

Figure 4:
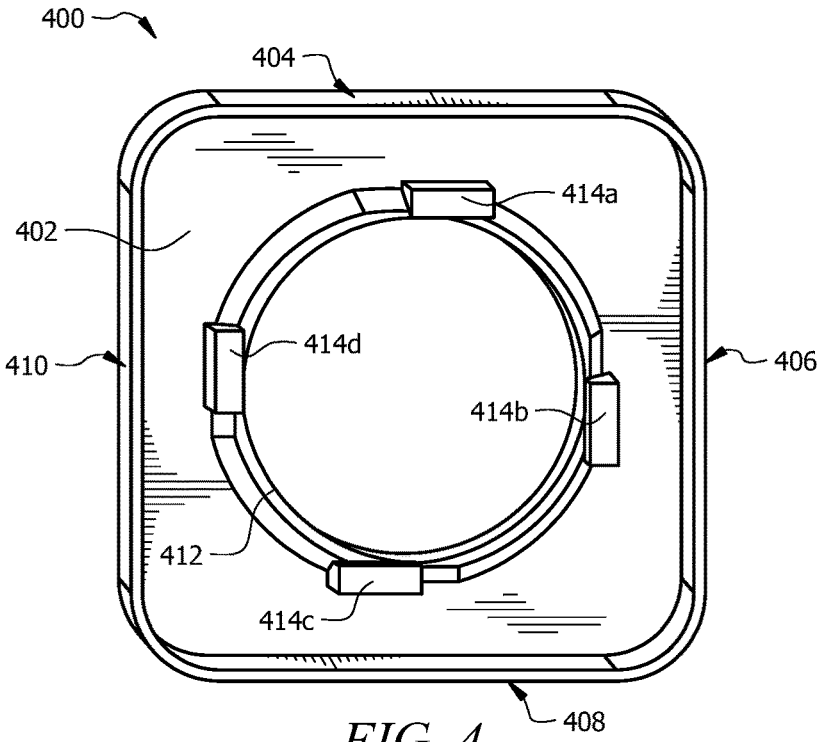
FIG. 4 illustrates an exemplary cap for the housing, in accordance with certain embodiments.

FIG. 4 illustrates an exemplary cap for the housing, in accordance with certain embodiments. More particularly, FIG. 4 illustrates cap 400 that may be removably coupled to housing 100 (e.g., at top portion 102). Cap 400 includes a top surface 402. In certain embodiments, cap 400 may also comprise first side surface 404, second side surface 406, third side surface 408, and fourth side surface 410. Top surface 402 includes a cap opening 412. Cap opening 412 may correspond in shape and size to opening 118 of top portion 102 of housing 100. The dimensions of cap 400 may correspond to those of housing 100 such that cap 400 fits snugly over top portion 102 of housing 100 such that cap opening 412 and opening 118 in top portion 102 of housing 100 align. When cap 400 is coupled to housing 100, each of first side surface 404, second side surface 406, third side surface 408, and fourth side surface 410 may cover a respective, corresponding area of one of first side portion 110, second side portion 112, third side portion 114, and fourth side portion 116 of housing 100.

In certain embodiments, cap 400 includes a plurality of projections 414. More particularly, in the example embodiment of FIG. 4 cap 400 includes four projections 414*a*, 414*b*, 414*c*, and 414*d*. In certain embodiments, when cap 400 is coupled to housing 100, each of projections 414*a*, 414*b*, 414*c*, and 414*d* presses down on a respective one of blades 148 in blade receptacles 108, which advantageously secures blades 148 in place (e.g., in lieu of or in addition to using fasteners to secure blades 148 in place).

Additionally, when cap 400 is coupled to housing 100, top surface 402 may advantageously provide a covering for second cavity 134 and fifth cavity 140, such that items stored therein (e.g., a magnifying glass in second cavity 134 and/or replacement blades, etc. in fifth cavity 140) are prevented from falling out of housing 100.

Figure 5A:
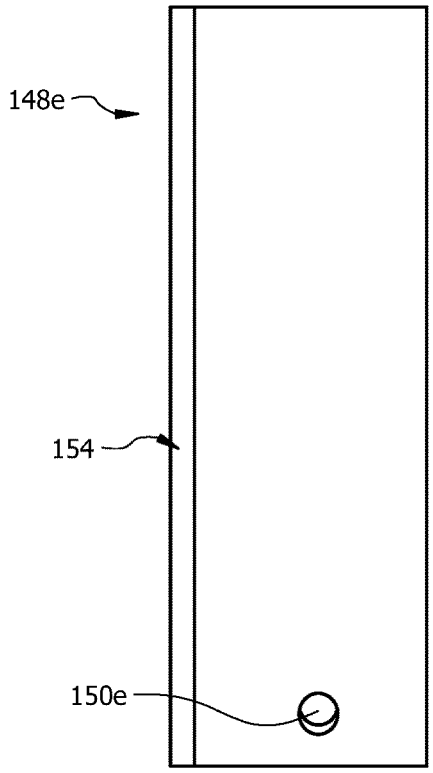
FIGS. 5A and 5B illustrate example blades, in accordance with certain embodiments.
Figure 5B:
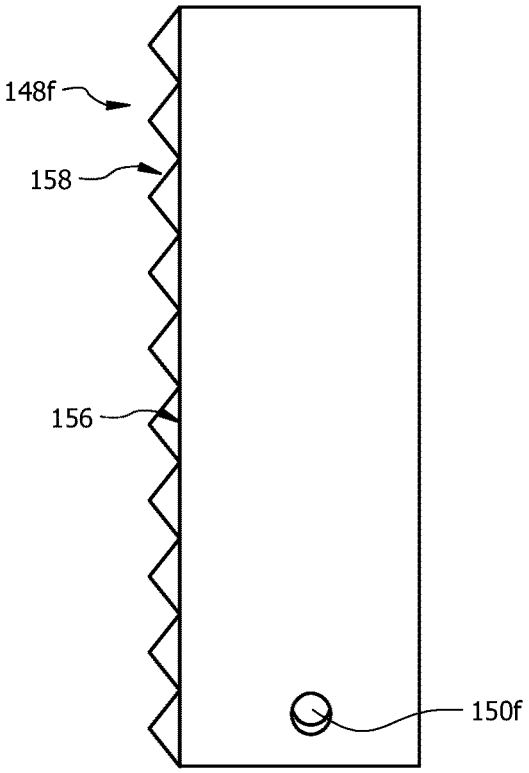

FIGS. 5A and 5B illustrate example blades, in accordance with certain embodiments. More particularly, FIG. 5A illustrates an example of a non-serrated blade 148*e* that may be used with housing 100 described above in relation to FIGS. 1-4. In the example embodiment of FIG. 5A, non-serrated blade 148*e* has an aperture 150*e* (which may, in certain embodiments, be used to secure blade 148*e* to housing 100 as described above) and an edge 154. Non-serrated blade 148*e* may be especially well-suited for sharpening hardwood.

FIG. 5B, meanwhile, illustrates an example of a serrated blade 148*f* that may be used with housing 100 described above in relation to FIGS. 1-4. Similar to non-serrated blade 148*e*, in the example embodiment of FIG. 5B serrated blade 148*f* has an aperture 150*f* (which may, in certain embodiments, be used to secure blade 148*f* to housing 100 as described above) and a serrated edge 156. Serrated edge 156 comprises a plurality of cutting teeth 158. In certain embodiments, the size and shape of cutting teeth 158 may vary (e.g., according to different implementations). For example, in certain embodiments serrated blade 148*f* may have five to ten teeth per inch. Serrated blade 148*f* may be especially well-suited for trimming fresh softwood or grinding materials such as bark, leaves, or coffee beans.

As can be seen from FIGS. 5A and 5B (and FIG. 4 above), the blades are shaped such that, when inserted in blade receptacles 108 of housing 100, the edges 154, 156 extend down second sections 128 of blade receptacles 108 to center piece 122 of bottom portion 104 without obscuring the discharge openings. Thus, the shape maximizes the cutting surface and allows for even sharpening.

Although blades 148*e* and 148*f* are shown in the example embodiments of FIGS. 5A and 5B as having respective apertures 150*e* and 150*f*, it should be understood that this is for purposes of example only. As described above, in certain embodiments blades 148 may be secured in housing 100 using a cap (e.g., cap 400 described above). In such a scenario, blades 148*e* and 148*f* may not include apertures 150*e* and 150*f*, respectively.

Figure 6:
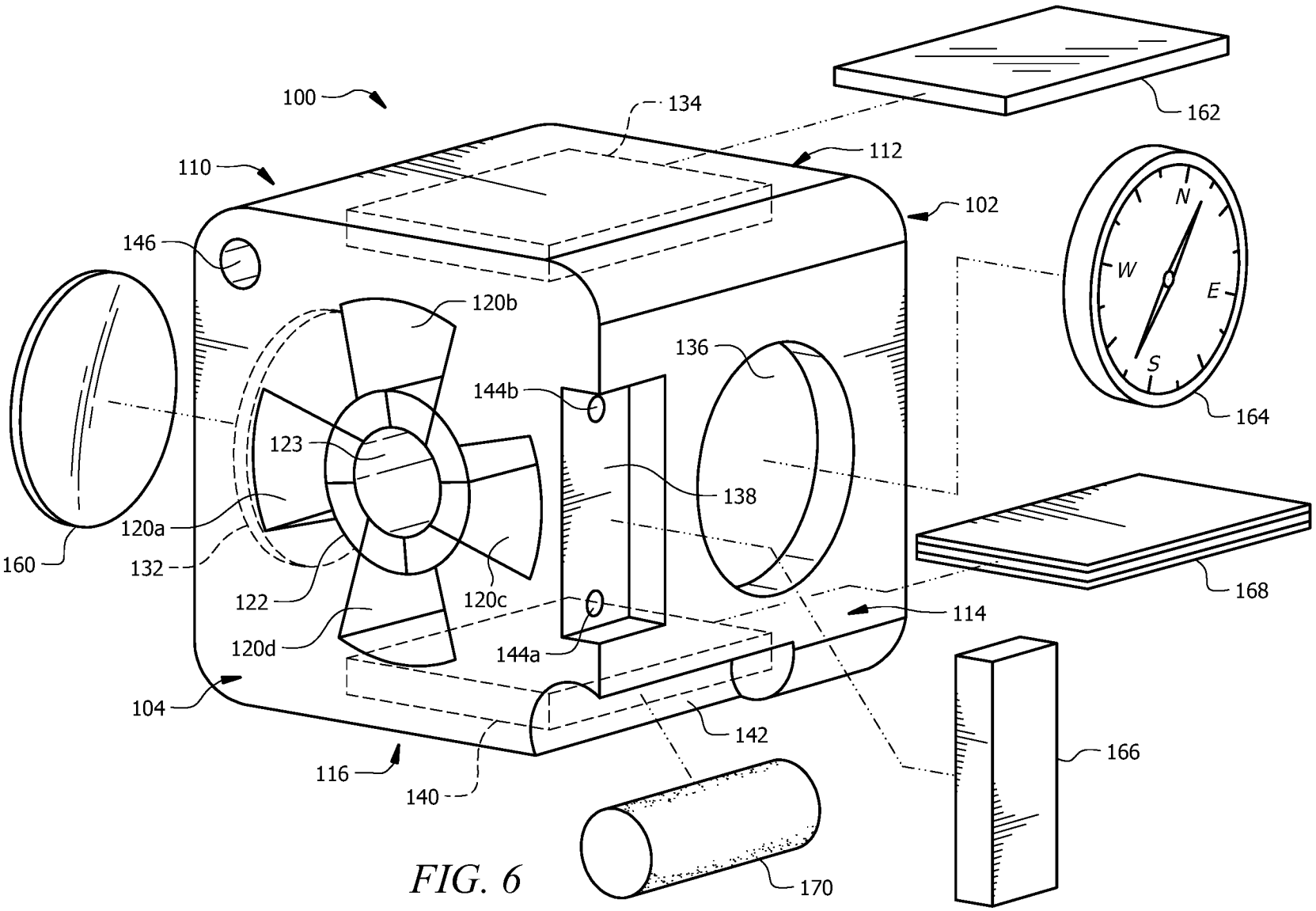
FIG. 6 illustrates an exploded view of the exemplary apparatus with a number of accessory tools incorporated with the housing, in accordance with certain embodiments.

FIG. 6 illustrates an exploded view of the exemplary apparatus with a number of accessory tools incorporated with the housing, in accordance with certain embodiments. More particularly, FIG. 6 illustrates an exploded view of housing 100 (described above in relation to FIGS. 1-3) with various accessory tools to demonstrate how, in one example embodiment, the various accessory tools may fit together with housing 100.

As described above in relation to FIGS. 1-3, first side portion 110 has a first cavity 132, second side portion 112 has a second cavity 134, third side portion 114 has a third cavity 136 and a fourth cavity 138, and fourth side portion 116 has a fifth cavity 140. Housing 100 also has a sixth cavity 142 disposed at a juncture between third side portion 114 and fourth side portion 116.

As described above in relation to FIG. 1, first cavity 132 may have a size and shape adapted to receive a mirror, such as mirror 160 shown in FIG. 6. Mirror 160 may be removably coupled to housing 100. For example, the dimensions of cavity 132 and mirror 160 may be complementary such that mirror 160 snaps into place, securing mirror 160 within cavity 132 in first side portion 110 of housing 100. Alternatively, in certain embodiments housing 100 may include one or more apertures in cavity 132 such that mirror 160 can be secured to housing 100 using one or more fasteners. In a survival situation, mirror 160 could, for example, be removed from first cavity 132 in housing 100 and used for signaling rescuers.

In the example embodiment of FIG. 6, second side portion 112 includes second cavity 134. In certain embodiments, second cavity 134 may have a size and shape adapted to receive a magnifying glass, such as magnifying glass 162 shown in FIG. 6. In a survival situation, magnifying glass 162 could be removed from second cavity 134 and used, for example, to focus sunlight so as to ignite tinder (e.g., wood shavings created using the apparatus) for emergency fire starting.

In the example embodiment of FIG. 6, third side portion 114 includes third cavity 136 and fourth cavity 138. In certain embodiments, third cavity 136 may have a size and shape adapted to receive a compass (e.g., a button compass), such as compass 164 shown in FIG. 6. Compass 164 may be removably coupled to housing 100. For example, the dimensions of cavity 136 and compass 164 may be complementary such that the compass snaps into place, securing compass 164 within cavity 136 in third side portion 114 of housing 100. Alternatively, in certain embodiments housing 100 may include one or more apertures in cavity 136 such that compass 164 may be secured to housing 100 using one or more fasteners. In a survival situation, compass 164 could be removed from third cavity 136 and used to navigate to safety. Outside of emergency scenarios, compass 164 could be removed from third cavity 136 and used to navigate to various points of interest.

In the example embodiment of FIG. 6, fourth cavity 138 in third side portion 114 may have a size and shape adapted to receive a blade sharpener, such as blade sharpener 166 shown in FIG. 6. Blade sharpener 166 may be secured to housing 100 using one or more fasteners (e.g., one or more screws) such that blade sharpener 166 is securely held in place during use. Housing 100 may include a corresponding number of apertures (e.g., apertures 144*a*, 144*b*) in fourth cavity 138 for receiving the one or more fasteners. Blade sharpener 166 may be removably coupled to housing 100 so that it can be replaced when worn down. Blade sharpener 166 can advantageously be used to sharpen one or more of the plurality of blades 148, sharpen other knives or perhaps a stone to form an edge.

As described above in relation to FIG. 1, fifth cavity 140 may have a size and shape adapted for storing one or more objects, such as survival booklet 168 shown in FIG. 6 or other suitable objects (e.g., an extra set of blades 148).

Sixth cavity 142 may have a size and shape adapted to receive a flint piece, such as flint piece 170 shown in the example embodiment of FIG. 6. Flint piece 170 may be removably coupled to housing 100. For example, the dimensions of sixth cavity 142 and flint piece 170 may be complementary such that flint piece 170 snaps into place, securing the flint piece within sixth cavity 142 disposed between third side portion 114 and fourth side portion 116 of housing 100. Alternatively, in certain embodiments housing 100 may include one or more apertures in cavity 142 such that flint piece 170 may be secured to housing 100 using one or more fasteners. In a camping or survival situation, flint piece 170 can be removed and used to generate sparks for fire starting (e.g., using wood shavings generated by the apparatus).

Figure 7:
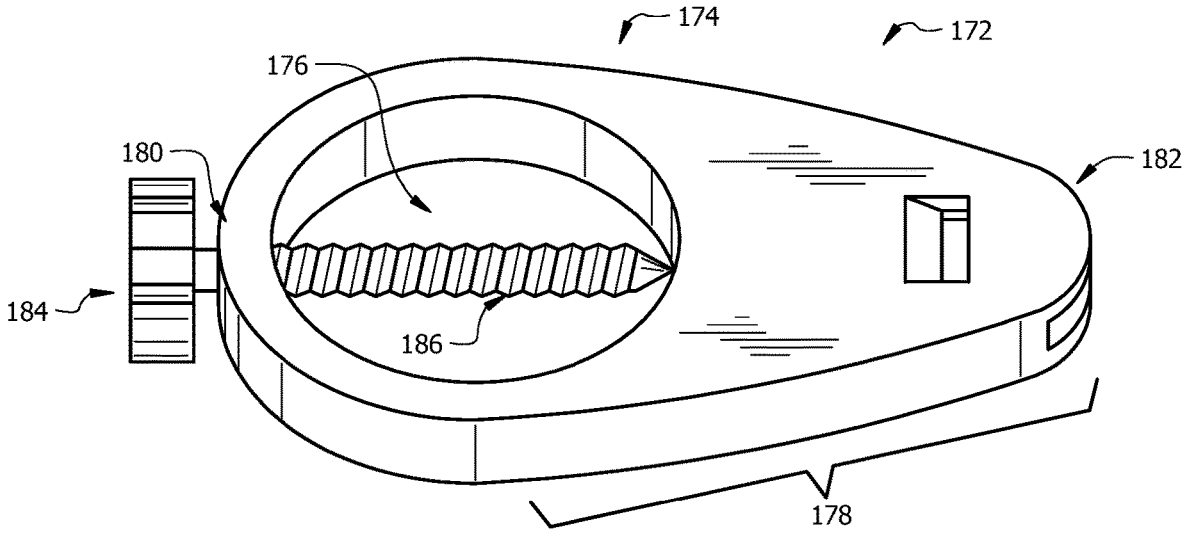
FIG. 7 illustrates an example of a hand tool that may be used with the exemplary apparatus, in accordance with certain embodiments.

FIG. 7 illustrates an example of a hand tool that may be used with the exemplary apparatus, in accordance with certain embodiments. More particularly, FIG. 7 illustrates hand tool 172. Hand tool 172 comprises a body portion 174. Body portion 174 includes a circular opening 176, a gripping portion 178, an aperture 180, and a whistle 182 disposed near gripping portion 178. Hand tool 172 further comprises a knob 184 affixed to shaft 186. The dimensions of aperture 180 and shaft 186 are adapted to allow shaft 186 to pass through aperture 180.

In operation, a stick or branch may be inserted into circular opening 176. Shaft 186 may be inserted through aperture 180 until it contacts the stick or branch inserted in circular opening 176. In certain embodiments, shaft 186 is threaded and pointed at an end not affixed to knob 184. A user may turn knob 184 (clockwise or counterclockwise, depending on the direction of the threading of shaft 186), driving shaft 186 into the stick or branch and to secure it within hand tool 172. A user may then insert an end of the stick or branch into circular opening 118 of housing 100 to make contact with blades 148 inserted therein. Facilitated by gripping portion 178, a user may rotate hand tool 172 and thereby rotate the stick or branch in housing 110 to shave, sharpen, or grind materials as needed. Gripping portion 178 facilitates sharpening, shaving, or grinding materials using housing 100 and blades 148 by making it easier for a user to turn the branch and providing improved torque. In certain embodiments, gripping portion 178 has an ergonomic design that allows a user to comfortably grip hand tool 172.

Figure 8:
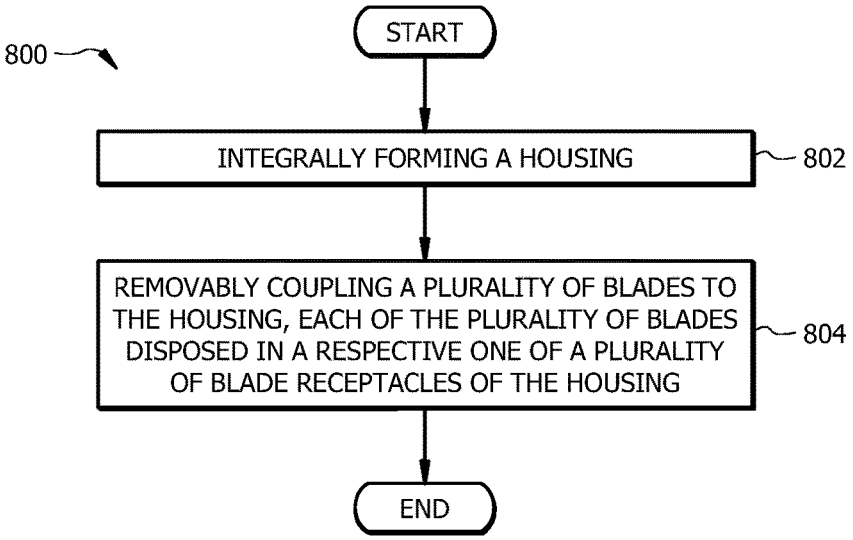
FIG. 8 is a flow diagram of a method, in accordance with certain embodiments.

FIG. 8 is a flow diagram of a method 800, in accordance with certain embodiments. Method 800 begins at step 802, where a housing is integrally formed. In certain embodiments, the housing may comprise: a top portion, the top portion comprising an opening for receiving an object; a bottom portion disposed opposite the top portion, the bottom portion comprising a plurality of discharge openings arranged around a center piece of the bottom portion and a central discharge opening in the center piece; a plurality of support members disposed in an interior of the housing, each of the plurality of support members extending from an edge of the top portion proximate to the opening to the center piece of the bottom portion; a plurality of blade receptacles, each of the plurality of blade receptacles having a first section disposed in the top portion and a second section extending along an edge of one of the plurality of support members; and first, second, third, and fourth side portions.

In certain embodiments, integrally forming the housing may comprise 3-D printing the housing using one of ABS and polylactic acid. In certain embodiments, integrally forming the housing may comprise filling a mold of the housing with, for example, acrylic. In certain embodiments, integrally forming the housing may comprise using plastic injection molding to integrally form the housing.

In certain embodiments, the housing may have a substantially cubical shape.

In certain embodiments, an exposed surface of each of the plurality of support members may be abrasive. In certain embodiments, the method may comprise affixing an abrasive plate (e.g., a metal plate) to the exposed surfaces of the support members.

In certain embodiments, each of the first, second, third, and fourth side portions may comprise an aperture for receiving a fastener, each aperture aligned with a respective first section of one of the plurality of blade receptacles.

At step 804, a plurality of blades are removably coupled to the housing, each of the plurality of blades disposed in a respective one of a plurality of blade receptacles of the housing.

In certain embodiments, each of the plurality of blades may be removably coupled to the housing using a respective fastener, each respective fastener passing through an aperture for receiving a fastener in the first, second, third, or fourth side portions.

In certain embodiments, the method may comprise removably coupling a cap to the housing. The cap may comprise a plurality of projections arranged around a cap opening. The cap opening may substantially correspond in shape and size to the opening of the top portion. In certain embodiments, each of the plurality of projections may contact a respective one of the plurality of blades when the cap is coupled to the housing. In certain embodiments, the cap may cover one or more cavity openings when the cap is coupled to the housing.

In certain embodiments, one or more of the plurality of blades may have serrated edges.

In certain embodiments, one or more of the first, second, third, and fourth side portions of the housing may comprise one or more cavities. The one or more cavities may be adapted to hold one or more accessory tools. In certain embodiments, the method may comprise removably coupling a mirror to the housing in a cavity formed in one of the first, second, third, and fourth side portions. In certain embodiments, the method may comprise removably coupling a magnifying glass to the housing in a cavity formed in one of the first, second, third, and fourth side portions. In certain embodiments, the method may comprise removably coupling a compass to the housing in a cavity formed in one of the first, second, third, and fourth side portions. In certain embodiments, the method may comprise removably coupling a blade sharpener to the housing in a cavity formed in one of the first, second, third, and fourth side portions. In certain embodiments, the method may comprise removably coupling a flint piece to the housing in a cavity formed at a juncture between two of the first, second, third, and fourth side portions.

In certain embodiments, the first side portion may comprise a first cavity. The method may comprise removably coupling a mirror to the housing in the first cavity.

In certain embodiments, the second side portion may comprise a second cavity. The method may comprise removably coupling a magnifying glass to the housing in the second cavity.

In certain embodiments, the third side portion may comprise a third cavity and a fourth cavity. The method may comprise removably coupling a compass to the housing in the third cavity. The method may comprise removably coupling a blade sharpener to the housing in the fourth cavity.

In certain embodiments, the fourth side portion may comprise a fifth cavity. In certain embodiments, the method may comprise storing one or more items (e.g., a survival booklet and/or a plurality of replacement blades) in the fifth cavity.

In certain embodiments, a sixth cavity may be disposed at a juncture between the third side portion and the fourth side portion. The method may comprise removably coupling a flint piece to the housing in the sixth cavity.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure, as defined by the following claims.

The invention claimed is:

1. An apparatus, comprising:

an integrally formed housing, the housing having a substantially cubical shape and comprising:

a top portion, the top portion comprising an opening for receiving an object to be sharpened or shredded;

a bottom portion disposed opposite the top portion, the bottom portion comprising a plurality of discharge openings arranged around a center piece of the bottom portion and a central discharge opening in the center piece;

a plurality of support members disposed in an interior of the housing, each of the plurality of support members extending from an edge of the top portion proximate to the opening to the center piece of the bottom portion;

a plurality of blade receptacles, each of the plurality of blade receptacles having a first section disposed in the top portion and a second section extending along an edge of one of the plurality of support members;

first, second, third, and fourth side portions, wherein:

the first side portion comprises a first cavity;

the second side portion comprises a second cavity;

the third side portion comprises a third cavity and a fourth cavity;

the fourth side portion comprises a fifth cavity; and a sixth cavity is disposed at a juncture between the third side portion and the fourth side portion;

a plurality of blades, each of the plurality of blades disposed in a respective one of the plurality of blade receptacles of the housing;

a mirror removably coupled to the housing in the first cavity;

a compass removably coupled to the housing in the third cavity;

a blade sharpener removably coupled to the housing in the fourth cavity; and a flint piece removably coupled to the housing in the sixth cavity.

2. The apparatus of claim 1, further comprising a cap removably coupled to the housing, the cap comprising a plurality of projections arranged around a cap opening, the cap opening substantially corresponding in shape and size to the opening of the top portion, wherein each of the plurality of projections contacts a respective one of the plurality of blades when the cap is coupled to the housing.

3. The apparatus of claim 2, wherein the cap covers an opening of the second cavity and an opening of the fifth cavity when the cap is coupled to the housing.

4. The apparatus of claim 1, wherein the housing is formed of acrylonitrile butadiene styrene.

5. The apparatus of claim 1, wherein an exposed surface of each of the plurality of support members is abrasive.

6. The apparatus of claim 1, wherein one or more of the plurality of blades comprises a serrated edge.

7. An apparatus, comprising:

a housing, the housing comprising:

a top portion, the top portion comprising an opening for receiving an object;

a bottom portion disposed opposite the top portion, the bottom portion comprising a plurality of discharge openings arranged around a center piece of the bottom portion;

a plurality of support members disposed in an interior of the housing, each of the plurality of support members extending from an edge of the top portion proximate to the opening to the center piece of the bottom portion;

a plurality of blade receptacles, each of the plurality of blade receptacles having a first section disposed in the top portion and a second section extending along an edge of one of the plurality of support members; and first, second, third, and fourth side portions;

a plurality of blades, each of the plurality of blades disposed in a respective one of the plurality of blade receptacles of the housing; and a cap removably coupled to the housing, the cap comprising a plurality of projections arranged around a cap opening, the cap opening substantially corresponding in shape and size to the opening of the top portion, wherein each of the plurality of projections contacts a respective one of the plurality of blades when the cap is coupled to the housing.

8. The apparatus of claim 7, wherein the cap covers one or more cavity openings when the cap is coupled to the housing.

9. The apparatus of claim 7, wherein the housing is integrally formed.

10. The apparatus of claim 7, wherein the housing has a substantially cubical shape.

11. The apparatus of claim 7, further comprising:

a mirror removably coupled to the housing in a cavity formed in one of the first, second, third, and fourth side portions.

12. The apparatus of claim 7, further comprising:

a compass removably coupled to the housing in a cavity formed in one of the first, second, third, and fourth side portions.

13. The apparatus of claim 7, further comprising:

a blade sharpener removably coupled to the housing in a cavity formed in one of the first, second, third, and fourth side portions.

14. The apparatus of claim 7, further comprising:

a flint piece removably coupled to the housing in a cavity formed at a juncture between two of the first, second, third, and fourth side portions.

15. The apparatus of claim 7, wherein an exposed surface of each of the plurality of support members is abrasive.

16. The apparatus of claim 7, wherein one or more of the plurality of blades comprises a serrated edge.

17. A method, comprising:

integrally forming a housing, the housing comprising:

a top portion, the top portion comprising an opening for receiving an object;

a bottom portion disposed opposite the top portion, the bottom portion comprising a plurality of discharge openings arranged around a center piece of the bottom portion and a central discharge opening in the center piece;

a plurality of support members disposed in an interior of the housing, each of the plurality of support members extending from an edge of the top portion proximate to the opening to the center piece of the bottom portion;

a plurality of blade receptacles, each of the plurality of blade receptacles having a first section disposed in the top portion and a second section extending along an edge of one of the plurality of support members; and first, second, third, and fourth side portions;

removably coupling a plurality of blades to the housing, each of the plurality of blades disposed in a respective one of the plurality of blade receptacles of the housing; and removably coupling a cap to the housing, the cap comprising a plurality of projections arranged around a cap opening, the cap opening substantially corresponding in shape and size to the opening of the top portion, wherein each of the plurality of projections contacts a respective one of the plurality of blades when the cap is coupled to the housing.

18. The method of claim 17, wherein integrally forming the housing comprises one of:

3-D printing the housing using one of acrylonitrile butadiene styrene and polylactic acid;

filling a mold of the housing with acrylic; and integrally forming the housing using plastic injection molding.

* * * * *